US006386108B1

(12) United States Patent
Brooks et al.

(10) Patent No.: US 6,386,108 B1
(45) Date of Patent: May 14, 2002

(54) INITIATION OF EXPLOSIVE DEVICES

(76) Inventors: James E. Brooks, 9520 Oak Crest, Manvel, TX (US) 77578; Nolan C. Lerche, 12114 Dorrance, Stafford, TX (US) 77477

( * ) Notice: Subject to any disclaimer, the term of this patent is extended or adjusted under 35 U.S.C. 154(b) by 0 days.

(21) Appl. No.: 09/401,889

(22) Filed: Sep. 23, 1999

Related U.S. Application Data

(60) Provisional application No. 60/101,578, filed on Sep. 24, 1998, provisional application No. 60/109,144, filed on Nov. 20, 1998, provisional application No. 60/101,606, filed on Sep. 24, 1998, and provisional application No. 60/127,204, filed on Mar. 31, 1999.

(51) Int. Cl.[7] ..... F42D 1/02; F42D 1/05

(52) U.S. Cl. ..... 102/217; 102/217; 102/202.5; 102/202.7

(58) Field of Search ..... 102/217, 202.7, 102/202.5

(56) References Cited

U.S. PATENT DOCUMENTS

| | | | |
|---|---|---|---|
| 3,181,463 | A | 5/1965 | Morgan et al. |
| 3,327,791 | A | 6/1967 | Harrigan, Jr. |
| 3,366,055 | A | 1/1968 | Hollander, Jr. |
| 3,517,758 | A | 6/1970 | Schuster |
| 3,640,224 | A | 2/1972 | Petrick et al. |
| 3,640,225 | A | 2/1972 | Carlson et al. |
| 3,978,791 | A | 9/1976 | Lemley et al. |
| 4,137,850 | A | 2/1979 | Donner |
| 4,307,663 | A | 12/1981 | Stonestrom |
| 4,393,779 | A | 7/1983 | Brede et al. |
| 4,421,030 | A | 12/1983 | DeKoker |
| 4,422,381 | A | 12/1983 | Barrett |
| 4,441,427 | A | 4/1984 | Barrett |
| 4,471,697 | A | 9/1984 | McCormick et al. |

(List continued on next page.)

FOREIGN PATENT DOCUMENTS

| | | | |
|---|---|---|---|
| EP | 0 029 671 | | 9/1983 |
| EP | 0 601 880 | A2 | 6/1994 |
| EP | 0 604 694 | A1 | 7/1994 |
| EP | 0 675 262 | A1 | 10/1995 |
| EP | 0 675 262 | A | 10/1995 |
| GB | 677824 | | 8/1952 |
| GB | 693164 | | 6/1953 |
| GB | 2118282 | A | 10/1983 |
| GB | 2100395 | B | 8/1984 |
| GB | 2190730 | A | 11/1987 |
| GB | 2226872 | A | 7/1990 |
| GB | 2265209 | A | 9/1993 |
| GB | 2290855 | A | 1/1996 |
| WO | WO 96/23195 | | 8/1996 |
| WO | WO 98/38470 | | 9/1998 |
| ZA | 8368 | A1 * | 11/1973 |

OTHER PUBLICATIONS

James E. Brooks, A Simple Method for Estimating Well Productivity, Society of Petroleum Engineers 1–8 (Jun. 2–3, 1997).

"Performance Criteria for Small Slapper Detonators" Controller, Her Majesty's Stationary Office, London 1984.

(List continued on next page.)

*Primary Examiner*—Michael J. Carone
*Assistant Examiner*—Lulit Semunegus

(57) ABSTRACT

A perforating gun or other downhole tool includes one or more explosive devices that are activable by corresponding one or more initiator devices, such as capacitor discharge units (CDUs). Each CDU includes an explosive foil initiator (EFI) or some other type of a high-energy bridge-type initiator, an energy source (e.g., a slapper capacitor), and a switch coupling the energy source and the EFI or other bridge-type initiator. An electrical cable is coupled to the CDUs for providing a voltage to energize the energy source in the CDUs to provide energy to each EFI. In response to activation of a trigger signal down the electrical cable, the switch is closed to couple the energy source to the EFI.

34 Claims, 7 Drawing Sheets

U.S. PATENT DOCUMENTS

| | | | | |
|---|---|---|---|---|
| 4,517,497 | A | | 5/1985 | Malone |
| 4,527,636 | A | | 7/1985 | Bordon |
| 4,592,280 | A | | 6/1986 | Shores |
| 4,602,565 | A | | 7/1986 | MacDonald et al. |
| 4,632,034 | A | | 12/1986 | Colle, Jr. |
| 4,638,712 | A | | 1/1987 | Chawla et al. |
| 4,662,281 | A | | 5/1987 | Wilhelm et al. |
| 4,700,629 | A | | 10/1987 | Benson et al. |
| 4,708,060 | A | | 11/1987 | Bicks, Jr. et al. |
| 4,729,315 | A | | 3/1988 | Proffit et al. |
| 4,735,145 | A | | 4/1988 | Johnson et al. |
| 4,762,067 | A | | 8/1988 | Barker et al. |
| 4,777,878 | A | | 10/1988 | Johnson et al. |
| 4,788,913 | A | | 12/1988 | Stroud et al. |
| 4,831,933 | A | | 5/1989 | Nerheim et al. |
| 4,843,964 | A | | 7/1989 | Bickes, Jr. et al. |
| 4,886,126 | A | | 12/1989 | Yates, Jr. |
| 4,944,225 | A | | 7/1990 | Barker |
| 5,088,413 | A | | 2/1992 | Huber et al. |
| 5,094,166 | A | | 3/1992 | Hendley, Jr. |
| 5,094,167 | A | | 3/1992 | Hendley, Jr. |
| 5,172,717 | A | | 12/1992 | Boyle et al. |
| 5,347,929 | A | | 9/1994 | Lerche et al. |
| 5,413,045 | A | | 5/1995 | Miszewski |
| 5,444,598 | A | | 8/1995 | Aresco |
| 5,460,093 | A | | 10/1995 | Prinz et al. |
| 5,505,134 | A | | 4/1996 | Brooks et al. |
| 5,520,114 | A | | 5/1996 | Guimard et al. |
| 5,539,636 | A | | 7/1996 | Marsh et al. |
| 5,706,892 | A | | 1/1998 | Aeschbacher, Jr. et al. |
| 5,731,538 | A | * | 3/1998 | O'Brien et al. ..... 102/202.5 |
| 5,756,926 | A | | 5/1998 | Bonbrake et al. |

OTHER PUBLICATIONS

"New Developments in the Field of Firing Techniques" by K. Ziegler Propellants, Explosives, Pyrotechnics 12, 115–120 (1987).

"Application of Slapper Detonator Technology to the Design of Special Detonation Systems," by W. H. Meyers Proc. 12$^{th}$ Symposium on Explosives and Pyrotechnics, San Diego, California, Mar. 13–15, 1984, Detonation Systems Development, Los Alamos National Laboratory, pp. 4–5 through 4–19.

"CP DDT Detonators: II. Output Characterization," by M. L. Lieberman Sandia National Laboratories Report SAND 83–1893, Albuquerque, New Mexico, pp. 3–105 through 3–112.

"A Fast, Low Resistance Switch for Small Slapper Detonators," by D. D. Richardson and D. A. Jones Department of Defense Materials Research Laboratories Report MRL–R–1030, Victoria, Australia.

"The Effect of Switch Resistance on the Ringdown of a Slapper Detonator Fireset," by D. D. Richardson Department of Defense Materials Research Laboratories Report MRL–R–1004, Victoria, Australia.

"Flyer Plate Motion and Its Deformation During Flight," by H. S. Yadav and N. K. Gupta Int. J. Impact Engng, vol. 7, No. 1, 1998, pp. 71–83.

"Mossbauer Study of Shock–Induced Effects in the Ordered Alloy $Fe_{50}Ni_{50}$ In Meteorites," By R. B. Scorzelli, I. S. Azevedo, J. Danon and Marc A. Meyers J. Phys. F: Met. Phys. 17 (1987), pp. 1993–1997.

"Effect of Shock–Stress Duration on the Residual Structure and Hardness of Nickel, Chromel, and Inconel," by L. E. Murr and Jong–Yuh Huang Materials Science and Engineering, 19(1975), pp.115–122.

Critical Energy Criterion for the Shock Initiation of Explosives by Projectile Impact, by H. R. James Propellants, Explosives, Pyrotechnics 13, (1988), pp. 35–41.

"High–Temperature–Stable Detonators," by R. H. Dinegar Proc. 12$^{th}$ Smposium on Explosives and Pyrotechnics, San Diego, California, Mar. 13–15, Los Alamos National Laboratory, pp. 4–1 through 4–4.

"Shock Initiation of PETN," by J. C. Cheng Monsanto Research Corporation, Miamisburg, Ohio, pp. 1–31 through 1–35.

"Exploding Metallic Foils for Slapper, Fuse, and Hot Plasma Applications: Computational Predictions, Experimetal Observations," by I. R. Lindemuth, J. H. Brownell, A. E. Greene, G. H. Nickel, T. A. Oliphant and D. L. Weiss, Thermonuclear Applications Group, Applied Theoretical Physics Division, and W. F. Hemsing and I. A. Garcia, Detonation Systems Group, Dynamic Testing Division, Los Alamos National Laboratory, Los Alamos, New Mexico, pp. 299–305.

"A New Kind of Detonator—The Slapper," by J. R. Stroud Lawrence Livermore Laboratory, University of California, Livermore, California, pp. 22–1 through 22–6.

"Pyrotechnic Ignition in Minislapper Devices," by D. Grief and D. Powell Awre, Aldermaston, Reading RG7 4PR, Berkshire, England, Controller, HMSO, London, 1981, pp. 43–1 through 43–10.

"Exploding Foils—The Production of Plane Shock Waves and the Acceleration of Thin Plates," by D. V. Keller & J. R. Penning, Jr. The Boeing Company, Seattle, Washington, pp. 263–277.

"Acceleration of Thin Plates by Explosing Foil Techniques," by A. H. Guenther, D. C. Wunsch and T. D. Soapes Pulse Power Laboratory, Physics Division, Research Directorate Air Force Special Weapons Center, Kirtland Air Force Base, New Mexico, pp. 279–298.

"A Low–Energy Flying Plate Detonator," by A. K. Jacobson Sandia National Laboratories Report, SAND 81–0487C, Albuquerque, New Mexico, 1981, pp. 49–1 through 49–20.

"Sequential Perforations in Boreholes," by H. Lechen ANTARES Datensysteme GmbH, Jan. 1998.

"A Simple Method for Estimating Well Productivity," by J. E. Brooks, SPE European Formation Damage Conference, The Hague, The Netherlands, 2–3 Jun., 1997.

"Unique Features of SCBs," by P. D. Wilcox and "SCB Explosive Studies" by R. W. Bickes, Jr. Initiating and Pyrotechnic Components Division 2515.

* cited by examiner

INITIATION OF EXPLOSIVE DEVICES

INITIATION OF EXPLOSIVE DEVICES

This application claims priority under 35 U.S.C. § 119(e) to U.S. Provisional Patent Application Ser. No. 60/101,578, entitled "Initiators Used in Explosive Devices," filed Sep. 24, 1998; U.S. Provisional Patent Application Ser. No. 60/109,144, entitled "Switches for Use in Tools," filed Nov. 20, 1998; U.S. Provisional Patent Application Ser. No. 60/101,606, entitled "Switches Used in Tools," filed Sep. 24, 1998; and U.S. Provisional Patent Application Ser. No. 60/127,204, entitled "Detonators for Use With Explosive Devices," field Mar. 31, 1999.

BACKGROUND

The invention relates to initiation of explosive devices for use in various applications, including wellbore applications.

In completing a well, different types of equipment and devices are run into the well. For example, a perforating gun string can be lowered into a wellbore proximal a formation that contains producible fluids. The perforating string is fired to create openings in surrounding casing as well as to extend perforations into the formation to establish production of fluids. Other completion devices that may be run into a wellbore include packers, valves, and other devices.

A detonating cord is one type of initiator that has been used to detonate explosives in perforating guns as well as other devices. In a perforating gun, shaped charges are coupled to a detonating cord, which when initiated causes the shaped charges to fire. A detonating cord detonates at a certain speed (e.g., about 7 to 8.5 kilometers per second). As a result, consecutive shaped charges may fire with a typical delay of about 5 to 10 microseconds of one another, depending on the distance between successive charges. Although the detonation wave traveling down the cord is relatively fast, some separation between charges is needed to reduce the likelihood that the detonation of one charge interferes with the subsequent detonation of an adjacent charge. The separation distance required for proper firing of charges is usually about one charge diameter, although distance may vary depending on the application.

In some arrangements of perforating guns, multiple charges may be arranged in a plane so that simultaneous firing of charges in one plane is possible. However, some separation is still needed between charge planes to prevent charges in one plane from interfering with the firing of charges in another plane. The shot separation requirement reduces the shot density of a perforating gun. Increasing the shot density of a perforating gun typically increases the productivity of a well. Most modem perforating guns are designed to give the maximum shot density possible within the limitations of the detonating cord. The detonating cord may be initiated by a percussion detonator or by an electrical detonator.

Another type of initiator for activating explosive devices such as shaped charges include exploding foil initiators (EFIs), which is electrically activated. An EFI typically includes a metallic foil connected to a source of electric current. A reduced neck section having a very small width is formed in the foil, with an insulator layer placed over a portion of the foil including the neck section. When a high current is applied through the neck section of the foil, the neck section explodes or vaporizes. This causes a small flyer to shear from the insulator layer, which travels through a barrel to impact an explosive to initiate a detonation. Other electrically activated initiators include exploding bridgewire (EBW) initiators, exploding foil "bubble activated" initiators, and others.

Multiple EFIs may be coupled to an electrical line and placed in close proximity with shaped charges. An activation current may be generated in the electrical line to activate the multiple EFIs. Such an arrangement allows multiple explosives to be initiated with nanosecond simultaneity. However, in one prior EFI system, the electric power is provided by a power source that includes a CMF (compressed magnetic field) power source capable of providing high current. A flat flexible cable is used to distribute the relatively high power to the EFIs. However, providing such relatively high power in a downhole environment may be difficult to accomplish.

In another distributed architecture in which lower power is employed to activate initiators, semiconductor bridge (SCB) initiators are employed. The SCB initiators are included in corresponding shaped charges, with an electrical wire routed to each SCB initiator. Although SCB initiators are useful for some purposes, EFI or EBW initiators are more desirable for some applications. For example, although SCB initiators require less power, they are generally slower than typical EFI and EBW initiators. As a result, desired simultaneously of detonation of explosives may not be achievable with SCB initiators.

A need thus exists for an initiation device including EFI, EBW, or other like initiators that can be activated with reduced electrical power to detonate explosive devices.

SUMMARY

In general, according to one embodiment, a tool includes a plurality of explosive devices and a plurality of initiator devices each including a bridge-type initiator and adapted to detonate a corresponding explosive device. Each initiator device includes an energy source, and an electrical cable is adapted to energize the energy source in each initiator device. Each energy source provides activation power to a corresponding bridge-type initiator.

Other features and embodiments will become apparent from the following description and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. For example, although reference is made to activating shaped charges in perforating gun strings, initiator devices in accordance with some embodiments may be employed to activate explosive devices or components in other types of tools or devices (e.g., in mining or other applications). In addition, although reference is made to specific voltage and capacitance values, further embodiments may employ lower or higher voltage or capacitance values.

As used here, the terms "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right or right to left relationship as appropriate.

Figure 1:
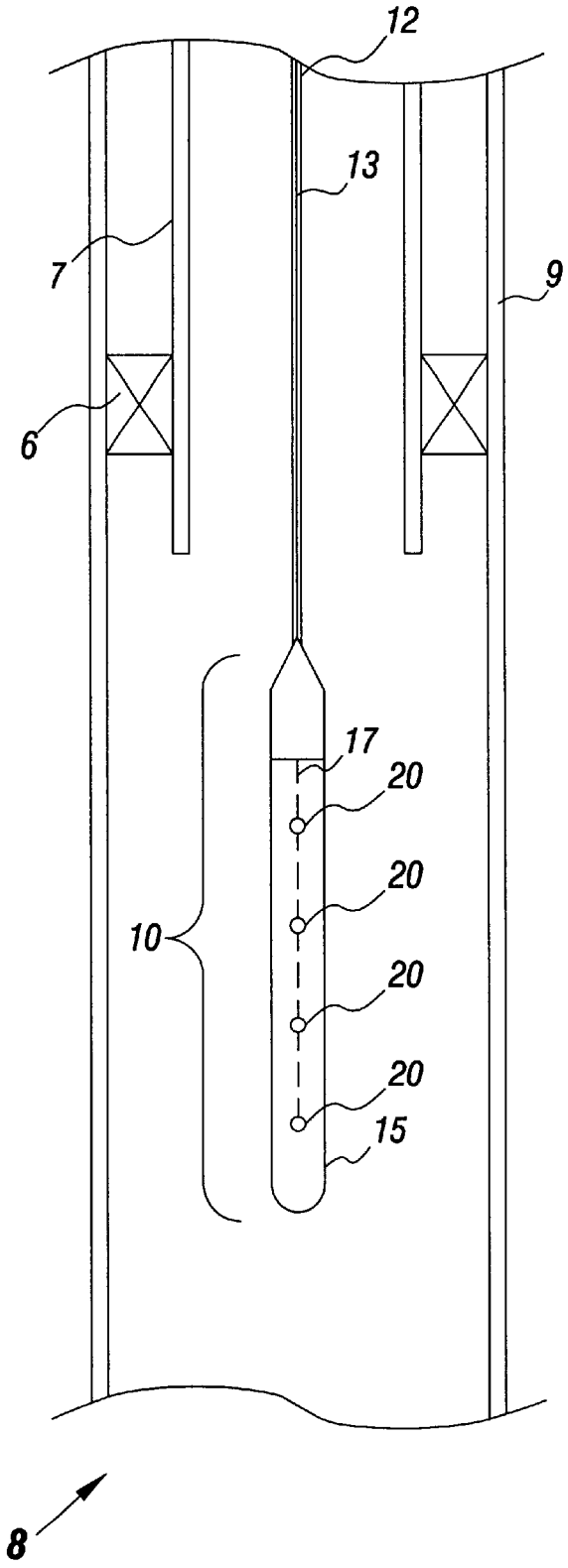
FIG. 1 illustrates an embodiment of a perforating gun string for use in a wellbore.

Referring to FIG. 1, a downhole tool 10, which may include a perforating gun 15 in one example, is lowered down through a tubing 7 that is positioned in a wellbore 8 lined with casing 9. A packer 6 is set between the tubing 7 and the casing 9 to isolate the tubing-casing annulus. In accordance with some embodiments of the invention, a carrier 12 is used to carry the downhole tool 10. The carrier 12 may include electrical conductors 13, such as those passed through wireline or coiled tubing (hereinafter also referred to as "carrier cable 13"). Alternatively, the carrier 12 may be a slickline or other carrier without electrical conductors. If the carrier 12 includes electrical conductors 13, power and signals passed down the electrical conductors are communicated to carry signals for activating explosive devices 20 (which may be shaped charges in one example). This is distinct from typical arrangements in which a detonating cord is attached to activate explosive devices. By using electrical signals in the electrical cable 17 to activate the explosive devices 24, substantially simultaneous detonation of the shaped charges is possible. If the carrier 12 does not include electrical conductors, then downhole power may be provided by a battery lowered into the well with the downhole tool 10.

In accordance with some embodiments, to reduce the instantaneous power and current needed in the cable 17, some embodiments of perforating gun tools include shaped charges each coupled to a relatively small integrated circuit that includes an initiator device such as a capacitor discharge unit (CDU) having an energy source (such as a "slapper" capacitor), bleed resistor, switch, and an EFI (exploding foil initiator) circuit. A CDU may be built as part of the shaped charge or attached to the back of the shaped charge. A series of CDUs associated with corresponding shaped charges are coupled to the electrical cable 17. Each slapper capacitor is trickle-charged through the electrical cable 17 to a relatively high voltage, then discharged upon command by a signal (which may be a relatively low-voltage signal) transmitted down the cable 17. This results in a nearly simultaneous (e.g., within about 200 nanoseconds) detonation of the shaped charges coupled to the electrical cable 17. In other embodiments that employ initiator devices having energy sources other than capacitors, such energy sources may be energized by a voltage on the electrical cable 17. The energized energy sources may then be triggered to couple their energy to respective EFI circuits.

As used here, "exploding foil initiator" may be of various types, such as exploding foil "flying plate" initiators and exploding foil "bubble activated" initiators. In addition, in further embodiments, exploding bridgewire initiators may also be employed. Such initiators, including EFIs and EBW initiators, may be referred to generally as high-energy bridge-type initiators in which a relatively high current is dumped through a wire or a narrowed section of a foil (both referred to as a bridge) to cause the bridge to vaporize or "explode." The vaporization or explosion creates energy to cause a flying plate (for the flying plate EFI), a bubble (for the bubble activated EFI), or a shock wave (for the EBW initiator) to detonate an explosive. In the ensuing description, reference is made to the "flying plate" type EFI. However, in further embodiments, other types of high-energy bridge-type initiators may be used.

The advantages that may be provided by such initiation mechanisms when used with a perforating gun may include one or more of the following: (1) charges can be packaged closer together (to achieve higher shot density) while still providing relatively high performance without the interference that would otherwise be present with a slower initiating detonating cord, (2) reduced instantaneous power and current requirements on the electrical cable 17 to activate the CDUs, (3) the charges may be center initiated at the detonation pressure of the explosive, resulting in better performance, and (4) increased safety because the detonating cord may be eliminated from the perforating gun. In addition, EFI and EBW initiators have faster response times as compared to SCB (semiconductor bridge) initiators. Consequently, with EFI and EBW initiators, nanosecond simultaneity of activation may be achievable.

By distributing slapper capacitors or other types of energy sources associated with the shaped charges to store the charge needed to activate the CDUs, the instantaneous power and current that needs to be transferred over the electrical cable 17 can be reduced. One difference between some embodiments of the invention and prior EFI systems is that the present system no longer requires high power to be "steered" and distributed down an electrical cable, which may be difficult to accomplish particularly with a long cable and its associated high impedance. Instead, according to some embodiments, the source of energy for the EFI circuits are distributed and localized at the shaped charges.

Also, improved design of the CDU in accordance with some embodiments allows for activation of the CDU with a reduced voltage as compared to prior CDUs. In a prior system, a capacitor (e.g., having a capacitance of approximately 0.1 $\mu$F) is charged to about 2,700 volts to reliably fire an EFI circuit. The prior EFI detonators are relatively large in size; as a result, it is impractical to distribute such detonators close to corresponding shaped charges. In contrast, according to some embodiments of the invention, more energy efficient EFI circuits are used. The energy source to fire an EFI circuit according to some embodiments is provided by charging a capacitor to a lower voltage. These capacitors are charged through the electrical cable 17 over a relatively short time period (e.g., several minutes), from a power source located at the well surface or provided by a downhole battery (if no carrier cable 13 is not provided). The capacitors are then discharged to activate associated EFI circuits. The capacitors may be charged to about 800 to 1,500 volts. The combination of the relatively small capacitance and lower voltage (than prior systems) results in CDUs requiring substantially less energy for activation. The energy required by one embodiment of a CDU may be as low as 10% of the energy required in prior CDU systems. The lower firing energy allows smaller, more compact CDUs to be used that can be integrated with the shaped charges themselves at reasonable cost. In one embodiment, a CDU assembly may have a general dimension of about 0.3"×0.4"×0.16" or smaller.

Figure 2A:
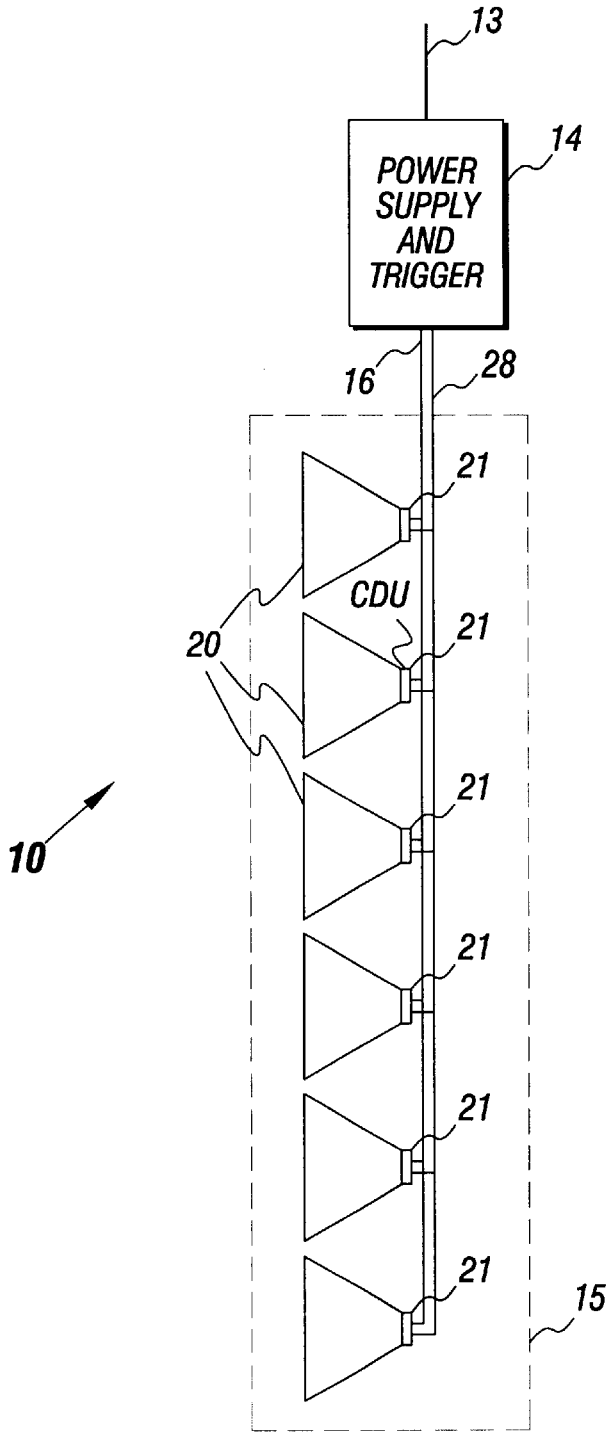
FIG. 2A illustrates a perforating gun in the perforating gun string of FIG. 1 that is activable by capacitor discharge units in accordance with an embodiment.
Figure 2B:
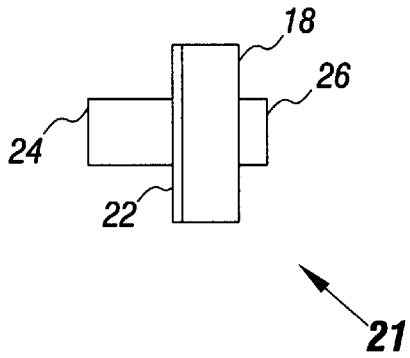
FIG. 2B illustrates one embodiment of a capacitor discharge unit.

Referring to FIG. 2A, according to one embodiment, the downhole tool 10 that includes the perforating gun 15 having shaped charges 20 is activable from the surface over the carrier cable 13 (e.g., a wireline). A well surface power supply and the carrier cable 13 are capable of delivering a predetermined voltage (e.g., between about 200–500 VDC) to a downhole activation module 14 that includes a power supply, triggering circuitry, and other circuitry. The power supply may include a voltage multiplier circuit to step the voltage received down the carrier cable 13 to a higher voltage (e.g., between about 800–1500 VDC) for distribution over a charge line 16 (that is part of the electrical cable 17) to charge up slapper capacitors 18 (or another type of local energy source) in or near the shaped charges 20. Each shaped charge 20 is associated with a relatively small CDU 21 (FIG. 2B) including the slapper capacitor 18, a bleed resistor 26, a triggerable switching circuit 18, a barrel (not shown in FIG. 2), and an EFI circuit 22, all located at or in the proximity of the back of the shaped charge 20 in one embodiment. Other arrangements of the CDU 21 and techniques for coupling the CDU 21 to the shaped charge 20 are also possible. Once the slapper capacitors 18 are fully charged, which may take only a few minutes, for example, a triggering signal is sent down a trigger line 28 (which is also part of the cable 17) to discharge substantially simultaneously (to within tens or hundreds of nanoseconds) all slapper capacitors 18. This, in turn, delivers energy to cause the EFI circuits 22 to launch small flyer plates that initiate high explosives 24 (slapper-grade explosives) that in turn detonate the shaped charges 20 in the gun.

Other embodiments are also possible. In one, the slapper capacitors are energized by a downhole battery rather than from a power source at the well surface. This may be used where the carrier 12 (such as a slickline or tubing) does not include electrical conductors, for example. In another embodiment, the voltage multiplier is obviated by increasing the surface voltage of the power source to an elevated level (e.g., between about 800–1500 VDC). In further embodiments, energy sources other than slapper capacitors may be employed in the initiator devices.

In summary, a system providing multipoint initiation of explosive devices is described that includes a series of explosive devices each associated with an initiator device (such as a CDU) that includes an EFI (or other bridge-type initiator), a slapper-grade explosive, an energy source such as a capacitor, and a triggerable switching circuit. The system also includes an electrical cable to deliver charging voltage to charge the capacitors (or other types of local energy sources) in the initiator devices. The electrical cable includes distributive wiring coupling a charging voltage to the initiator devices and a triggering signal from a triggering circuit to discharge substantially simultaneously the capacitors in the initiator devices.

Figure 3:
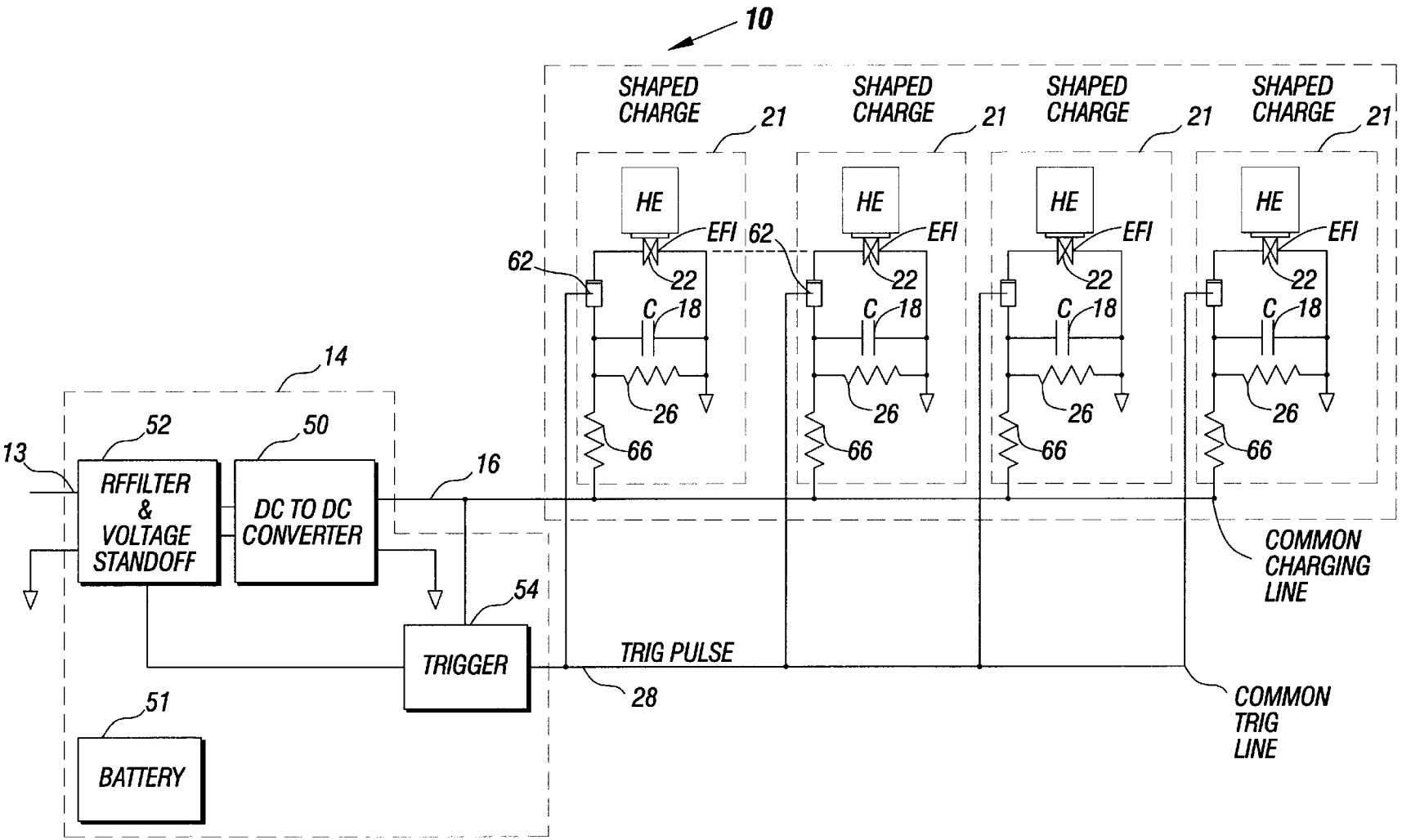
FIG. 3 is a circuit diagram of one arrangement of the circuitry used to activate the perforating gun of FIG. 2 in accordance with one embodiment.

Referring to FIG. 3, an electrical circuit diagram of the downhole tool 10 is illustrated. The control unit (not shown) at the well surface is equipped with a power source that is capable of sending a predetermined voltage down the carrier cable 13, which may be of a relatively long length (e.g., up to about 25,000 feet long or more). The activation module 14 of the downhole tool 10 may contain refilter and voltage standoff circuitry 52, a multiplier circuit 50 (which may be a DC-to-DC converter) that multiplies voltage received over the carrier cable 13 to charge capacitors in CDUs coupled to the charge line 16, and a trigger circuit 54 that sends a triggering signal down the common trigger line 28 to activate the EFIs located in the CDUs 21 associated with the shaped charges 20. In another embodiment in which energy is provided by a downhole battery, the activation module 14 may also include a battery 51.

The multiplier circuit 50 steps up the voltage received over the carrier cable 13 from the surface from between about 200–500 VDC to between about 800–1500 VDC, for example. The multiplied voltage is delivered to the slapper capacitors 18 in the CDUs over the charge line 16. Once the capacitors 18 are fully charged, the trigger circuit 54 in the module 14 is activated (by a command received down the carrier cable 13, for example, or by a pressure pulse or hydraulic command). When activated, the trigger circuit 54 sends a signal pulse down the separate trigger line 28 that substantially simultaneously discharges the stored energy in each slapper capacitor 18 into corresponding EFI circuits 22 that, in turn, detonate the corresponding shaped charges 20.

The EFI circuit 22 in each CDU 21 is located generally where the detonating cord would ordinarily contact the back of each shaped charge 20. The slapper capacitor 18 may have a relatively small capacitance (e.g., about 0.08 $\mu$F) and may be made from a ceramic material, for example. The bleed resistor 26 is used to discharge the slapper capacitor 18 in case of a misfire and may have a high resistance value (e.g., about 200 MΩ). The triggerable switch circuit 62 (which may be a spark gap circuit or other switch) provides a fast mechanism for dumping the energy from the capacitor 18 to the EFI circuit 22. In some embodiments, each switch circuit 62 is integral with a corresponding EFI circuit 22, with both being built on the same support structure.

Optionally, in each CDU 21, a resistor 66 may be coupled between the line 16 and the slapper capacitor 18. In case of a short in the CDU 21, such as a short of the capacitor 18, the resistor 66 protects the line 16 from being shorted so that the remaining CDUs may continue to operate. The resistor 66 also reduce the likelihood of interference between discharge of CDUs.

The close coupling of the slapper capacitor 18 and integral switch/EFI assembly makes the CDU 21 efficient in providing energy quickly to the EFI circuit 22 because of the relatively low inductance and low resistance of the delivery path. In one example embodiment, the delivery path has an inductance of about 5 nH (nanohenries) and a resistance of about 20 mΩ (milliohms).

Several embodiments of an integrated assembly containing the EFI circuit 22 and the switch circuit 62 formed on the same support structure (e.g., a polished ceramic substrate) are discussed below.

Figure 4A:
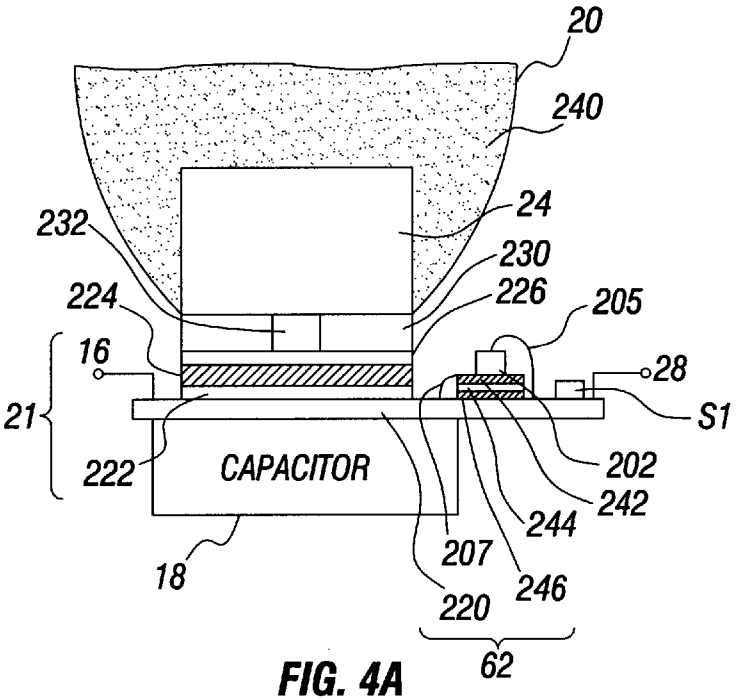

Referring to FIG. 4A, an arrangement of the initiator device 21 with the explosive device 20 is illustrated. The initiator device 21 may be a CDU having the EFI circuit 22 and a plasma diode switch in accordance with an embodiment. The EFI circuit 22 of the flyer plate type may be composed of relatively thin (submicron tolerance) deposited layers of an insulator 222, conductor 224, and insulator 226. In one embodiment, the insulator layers 222 and 226 may be formed of polyimide (e.g., KAPTON® or Pyralin), and the conductor layer 224 may be formed of a metal such as copper, aluminum, nickel, steel, tungsten, gold, silver, a metal alloy, and so forth. The layers 222, 224, and 226 forming the EFI circuit 22 may be formed on a support structure 220 (which may be formed of a material including ceramic, silicon, or other suitable material). In an alternative embodiment, the bottom insulator layer 222 of the EFI circuit 22 may be part of the support structure 220. The thinner, outer insulator layer 226 serves as a flyer or slapper that initiates the secondary high explosive 24, which may be HNS4, NONA, or other explosives. Upon activation of the EFI circuit 22, the flyer that breaks off the top insulator layer 226 flies through a barrel 232 in a spacer 230 to impact the high explosive 24. The high explosive 24 is in contact with the explosive 240 of the shaped charge 20. Detonation of the high explosive 24 initiates the shaped charge explosive 240 (or other explosive).

As an alternative, the flyer can be a composite of an insulating layer (e.g., KAPTON® or Pyralin) and a metal, such as aluminum, copper, nickel, steel, tungsten, gold, silver, and so forth. The efficiency of the EFI circuit 22 is enhanced by building the EFI circuit 22 with thin layers of metal and polyimide. A thin metalization layer is compatible with the lower ESL (equivalent series inductance) of the CDU.

Figure 5:
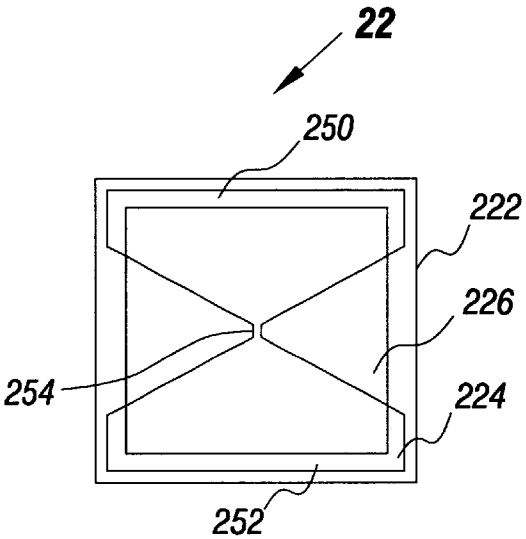
FIGS. 4–12 illustrate several different embodiments of portions of capacitor discharge units.

Referring to FIG. 5, a top view of the EFI circuit 22 according to the FIG. 4A embodiment is illustrated. The conductor layer 224 (which may be formed of a metal foil) sits on the bottom insulator layer 222. The conductor layer 224 includes two electrode portions 250 and 252 and a reduced neck portion 254. The top insulator layer 226 (which may be formed of polyimide or other insulator) covers a portions of both the conductor layer 224 (including the neck portion 254) and the bottom insulator layer 222. A voltage applied across electrodes 250 and 252 causes current to pass through the neck portion 254. If the current is of sufficient magnitude, the neck portion 254 may explode or vaporize and go through a phase change to create a plasma. The plasma causes a portion (referred to as the flyer) of the layer 226 to separate from and fly through the barrel 232. In one example embodiment, a flyer velocity of about 3 mm/$\mu$s may be achieved.

One embodiment of a method of forming the EFI circuit 22 may be as follows. The lower insulator layer 222 may be a ceramic material including aluminum and having a thickness of about 25 mils. A number of metal foils 224 may be formed on a sheet of ceramic substrate to make several EFI circuits at once. The metal foils may be deposited by sputter deposition or electronic beam deposition. Each metal foil 224 may include three metal layers, including layers of titanium, copper, and gold, as examples. Example thicknesses of the several layers may be as follows: about 500 Angstroms of titanium, about 3 micrometers of copper, and about 500 Angstroms of gold.

Following deposition of the metal layer 224, polyimide in flowable form may be poured onto the entire top surface of the ceramic substrate 222. A first coat of polyimide may be spun onto the ceramic substrate 222 at a predetermined rotational speed (e.g., about 2,900 rpm) for a predetermined amount of time (e.g., about 30 seconds). The polyimide layer can then be cured by soft baking in a nitrogen environment at a predetermined temperature (e.g., about 90° C.) for some predetermined amount of time (e.g., about 30 minutes). In one embodiment, a second coat of polyimide can be spun onto the ceramic substrate and the metal foil 224. After the polyimide layers have been spun on and cured, a layer of polyimide of about 10 micrometers is formed over the metal foil 224 and ceramic substrate 222. Next, the polyimide layer is selectively etched to remove all portions of the polyimide layer except for the portion above the reduced neck section of the foil 224.

Figure 4B:
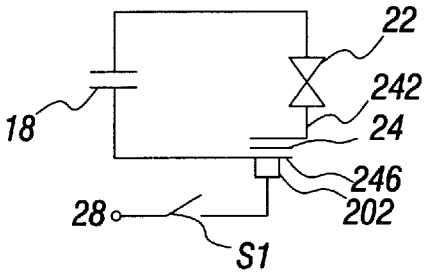

The switching circuit 62 may be integrated with the EFI circuit 22 on the same support structure 220. In one embodiment of the switching circuit 62, a Zener diode 202 is placed on a conductor/insulator/conductor (e.g., copper/polyimide/copper) assembly including conductor layers 242 and 246 and an insulator layer 244. Alternatively, instead of the Zener diode 202, another device having a P/N junction formed in doped silicon or other suitable material may be used. As further shown in the circuit diagram of FIG. 4B, the upper conductor layer 242 is electrically coupled to one node of the slapper capacitor 18 (over a wire 207) and to the Zener diode 202. The lower conductor layer 246 is electrically coupled to one electrode of the EFI circuit 22, such as through conductive traces in the support structure 220. The diode 202 breaks down in response to an applied voltage (over a wire 205) when the trigger line 28 activates a switch S1. In another embodiment, the switch S1 may be omitted, with the diode 202 coupled to the trigger line 28. The applied voltage on the trigger line 28 may range between about 50 and 250 VDC, for example. The characteristics of the diode 202 are such that it avalanches as it conducts current in response to the applied voltage, providing a sharp current rise and an explosive burst that punches through the upper conductor layer 242 and the insulation layer 244 to make an electrical connection to the other conductor layer 246 to close the circuit from the slapper capacitor 18 to the EFI circuit 22. This configuration is, in effect, a high-efficiency triggerable switch. There are also other switch embodiments that may be used.

As noted above, another type of EFI circuit includes an exploding foil "bubble activated" initiator. An example bubble activated EFI is disclosed in commonly assigned U.S. Pat. No. 5,088,413, to Huber et al., which is hereby incorporated by reference. The bubble activated EFI does not generate a flyer plate in response to vaporization of the neck portion of the foil. Instead, a polyimide layer of a predetermined thickness is deposited onto a foil bridge (with narrowed neck section), and when the neck section vaporizes or explodes in response to a high current flow through the foil, turbulence occurs under the polyimide layer to cause the polyimide layer above the neck section to form a bubble. The bubble expands at a rapid rate to cause detonation of an explosive upon impact.

Another type of a high-energy bridge-type initiator that may be employed is the EBW initiator, which includes a thin wire between two electrodes. A high current dumped through the wire causes the wire to explode or vaporize, which generates intense heat and shock wave. An explosive surrounding the wire is detonated by the shock wave.

The advantage of the described system in accordance with some embodiments over systems that use a detonating cord is that the initiation of the shaped charges is substantially instantaneous (to within 100 ns, for example). This allows charges to be packed closer together without having the detonation of one affecting the performance of an adjacent one. There is a distinct benefit derived by having higher packing or shot density in a perforating gun, including improved well productivity, as explained in James E. Brooks, "A Simple Method for Estimating Well Productivity," Society of Petroleum Engineers (1997). For example, if the productivity efficiency of a gun is low, increasing shot density is a good way to increase production, particularly where increasing the perforation length of the shaped charge jet is not an option.

There are also additional benefits of having an "electrical detonating cord." One is the centered initiation of the shaped charge that produces straighter perforating jets, which results in better penetration. The other is the safety benefit derived by eliminating one explosive component from the gun—the detonating cord.

Generally, it is desired that the switch circuit 62 for use in an initiator device be implemented with a switch having relatively high slew rate, low inductance, and low resistance. The switching circuit 62 can also operate at relatively high voltage and currents. As described in connection with FIGS. 4A, 4B, and 5, one such type of switch is the plasma switch.

Other types of switches include a fuse link switch, an over-voltage switch having an external trigger anode, a conductor/insulator/conductor over-voltage switch, a mechanical switch, or some other type of switch.

Figure 6:
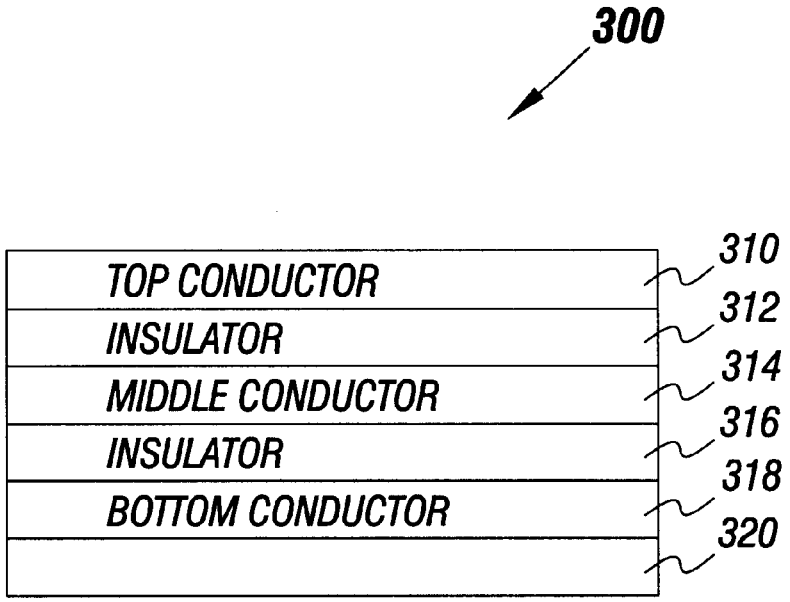
Figure 7:
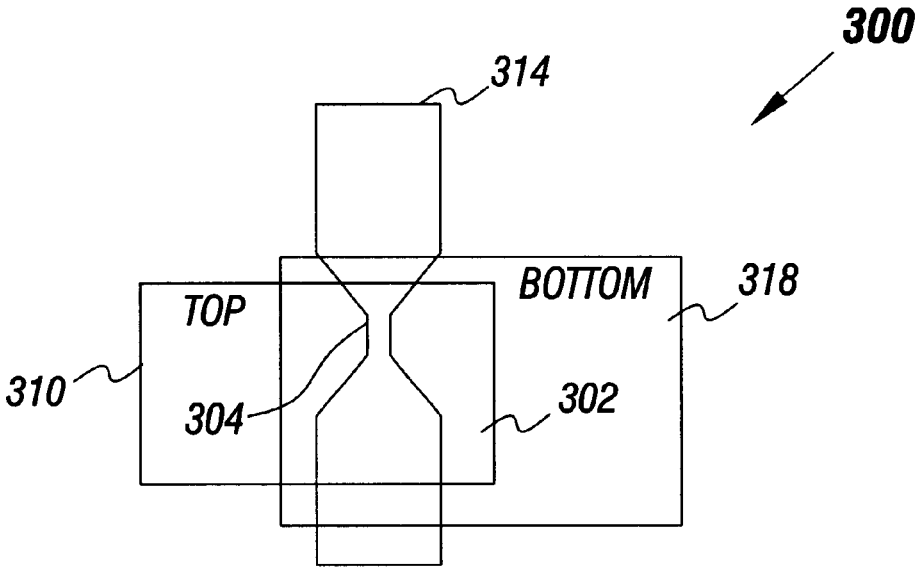

The plasma switch of FIGS. 4 and 5 includes a switch 62 having a Zener diode 202 and a conductor/insulator/conductor assembly including layers 242, 244, and 246. Another embodiment of a plasma switch (300) is shown in FIGS. 6 and 7. The plasma switch 300 includes a bridge 302 that may be formed of metal such as copper, aluminum, nickel, steel, tungsten, gold, silver, a metal alloy, and so forth. The bridge 302 is used in place of a silicon P/N junction such as that in the Zener diode 202 in the plasma diode switch 62 of FIG. 4A. The bridge 302 includes a reduced neck region 304 that explodes or vaporizes (similar to the reduced neck section of an EFI circuit) to form a plasma when sufficient electrical energy is dumped through the region 304. As shown in FIG. 6, the switch 300 may include five layers: a top conductor layer 310, a first insulator layer 312, an intermediate conductor layer 314 forming the bridge 302, a second insulator layer 316, and a bottom conductor layer 318. The top, intermediate and bottom conductor layers 310, 314, and 318 may be formed of a metal. The insulator layers 312 and 316 may be formed of a polyimide, such as KAPTON® or Pyralin. The switch 300 may be formed on a supporting structure 320 similar to the support structure 220 in FIG. 4A.

When sufficient energy (in the form of an electrical current) is provided through the bridge 302, the reduced region 304 explodes or vaporizes such that plasma perforates through the insulator layers 312 and 316 to electrically couple the top and bottom conductors 310 and 318. In one example embodiment, the layers may have the following thicknesses. The conductor layers 310, 314, and 318 may be approximately 3.1 micrometers ($\mu$m) thick. The insulator layer 312 and 316 may each be approximately 0.5 mils thick. The dimensions of the reduced neck region 304 may be approximately 4 mils by 4 mils.

In an alternative arrangement of the switch 300, the bridge may be placed over a conductor-insulator-conductor switch. The bridge may be isolated from the top conductor layer by an insulating layer. Application of electrical energy would explode or vaporize the bridge, connecting the top conductor to the bottom conductor.

Figure 8:
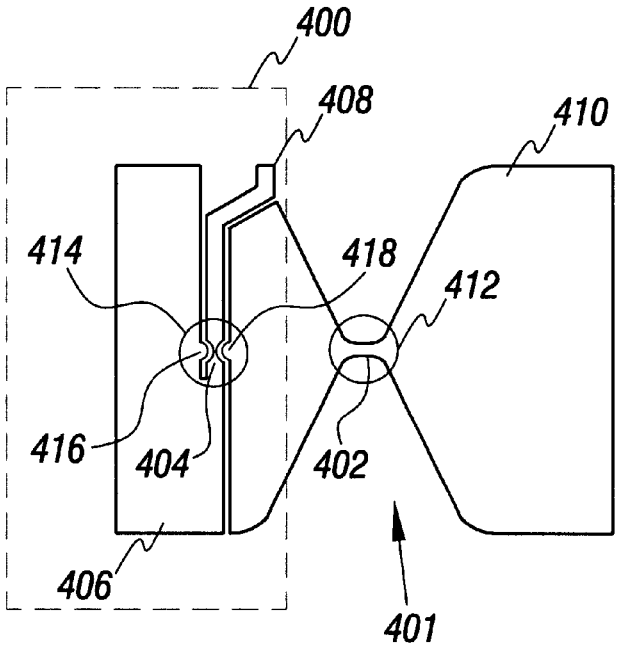
Figure 9:
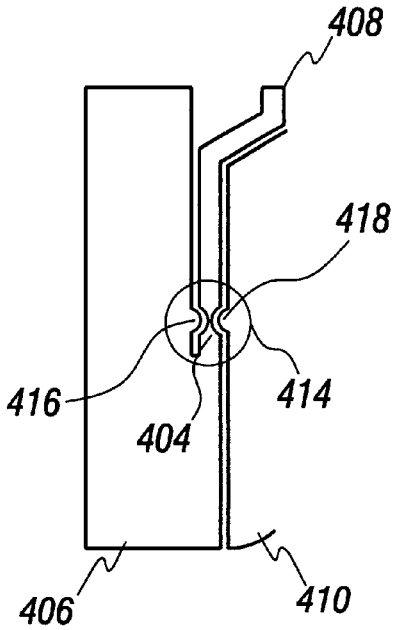

Referring to FIGS. 8 and 9, according to another embodiment, a fuse link switch 400 may be manufactured on a support structure (e.g., a ceramic substrate) and can be integrated with an initiator 401, such as an EFI circuit. In one embodiment, copper may be vacuum deposited or sputtered onto the ceramic substrate and a mask is used to etch the pattern shown in FIG. 8. One end of a fuse link 404 is electrically connected to a first conductor 406 and the other end of the fuse link 404 is connected to a trigger electrode 408 (which may be coupled to the trigger line 28). The fuse link 404 is also coated with a polyimide cover 414, which acts as an electric insulator to prevent electrical conduction between the conductor 406 and a second conductor 410.

The fuse link switch 400 may have the following specific dimensions according to one example embodiment. The fuse link 404 may be about 9 mils×9 mils in dimension. The fuse link 404 may be formed of one or more metal layers, e.g., a first layer of copper (e.g., about 2.5 $\mu$m) and a second layer of titanium (e.g., about 0.05 $\mu$m thick). The insulation cover 414 may be spin-on polyimide (e.g., about a 10 $\mu$m thick layer of P12540 polyimide). Electrodes 416 and 418 formed in the first and second conductors 406 and 410, respectively, may be coated with tungsten or other similar hardened metal. Spacing between the fuse link 404 and the electrodes 416 and 418 on either side may be of a predetermined distance, such as about 7 mils.

In operation, when an electric potential is placed across the conductors 406 and 410, no current flows between the two conductors because of the insulation cover 414 between them. However, if a sufficiently high voltage is applied at the trigger electrode 408, a phase change within the fuse link area may be induced. The heating effects of the fuse link 404 in turn breaks down the dielectric of the insulation cover 414, which when coupled with the phase change of the fuse link 404 creates a conductive path between the electrodes 416 and 418. This in effect closes the switch 400 to allow current between the conductor 406 and the conductor 410. A high current passing through a narrowed neck section 402 of the EFI conductor 410 causes vaporization of the neck section 402 to shear a flyer from layer 412 (e.g., a polymide layer).

Figure 10:
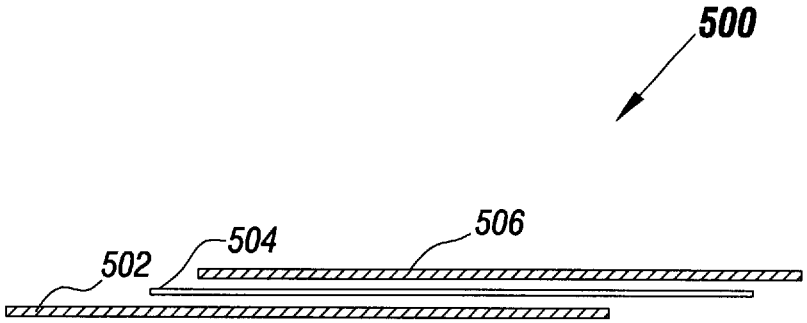

Referring to FIG. 10, according to another embodiment, an over-voltage switch 500 formed of a conductor/insulator/conductor structure may be used. The switch 500 includes a first conductor layer 502, an intermediate insulator layer 504, and a second conductor layer 506 that are formed of copper, polyimide and copper, respectively, in one example embodiment. The layers may be deposited onto a ceramic support structure. When a sufficient voltage is applied across conductor layers 502 and 506, breakdown of the insulating layer 504 may occur. The breakdown voltage is a function of the thickness of the polyimide layer 504. A 10-$\mu$m thick layer may break down around 3,000 VDC, for example. Breakdown of the insulator layer 504 causes a short between the conductor layers 502 and 506, which effectively closes the switch 500.

In another arrangement of the switch 500, each of the conductor layers 502 and 506 may include two levels of metal (e.g., about 2.5 $\mu$m of copper and 0.05 $\mu$m of titanium). The insulator layer 504 may include spin-on polyimide, such as KAPTON® or Pyralin.

Figure 11:
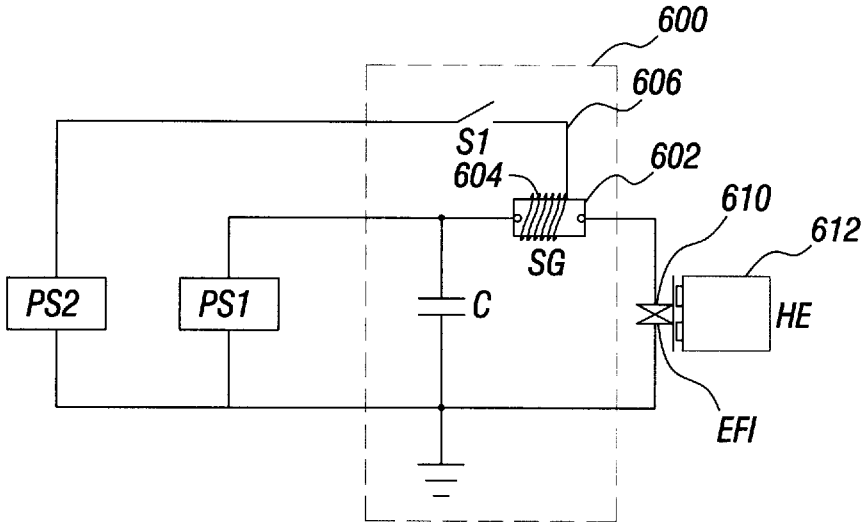

Referring to FIG. 11, which discloses yet another embodiment of a switch, a conventional over-voltage switch 600 may be modified such that it triggers at a voltage lower than its normal breakdown voltage. A wire 604 may be wound around a conventional spark gap 602 to provide a plurality of windings. One end of the wire 604 is floating and the other end is connected to a trigger anode 606 (connected to the trigger line 28, for example). A first supply voltage PS1 is set at a value that is below the firing voltage of the spark gap 602. A second supply voltage PS2 is set at a voltage that is to sufficient to ionize the spark gap 602 and cause the spark gap 602 to go into conduction. The voltage required is a function of the value difference between the supply voltage PS1 and the normal trigger voltage of the spark gap 602 and the number of turns of the wire 604 around the spark gap 602. In one example, for a 1400-volt spark gap 602 with a supply voltage PSI set at about 1200 volts, the number of turns of wire 604 around the spark gap 602 may be six. The supply voltage PS2 may be set at about 1000 volts. Upon closure of a switch S1, the spark gap 602 goes in conduction and dumps the capacitor charge into an EFI circuit 610, which in turn activates a high explosive (HE) 612.

Figure 12:
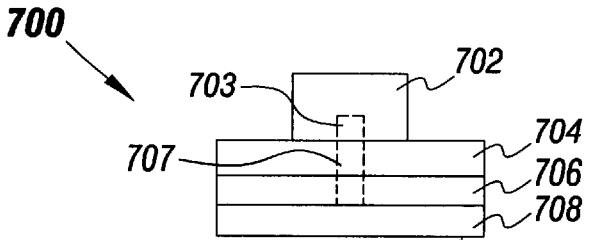

Referring to FIG. 12, according to yet another embodiment, a mechanical switch 700 that is activable by a microelectromechanical system 702 may be utilized. In this embodiment, the microelectromechanical system replaces the thumbtack actuator used in conventional thumbtack switches. The switch 700 includes top and bottom conductor layers 704 and 708 sandwiching an insulator layer 706. The conductor layers 704 and 708 may each be formed of a metal. The insulator layer 706 may include a polyimide layer. The microelectromechanical system 702 may be placed over the top conductor layer 704. When actuated, such as by an applied electrical voltage having a predetermined amplitude, an actuator 703 in the microelectromechanical system 702 moves through the layers 704 and 706 to contact the bottom conductor layer 708. This electrically couples the top and bottom conductors 704 and 706 to activate the switch 700. In one embodiment, an opening 707 may be formed through the layers 704 and 706 through which the actuator 703 from the microelectromechanical system 702 may travel. In another embodiment, the actuator 703 from the microelectromechanical system 702 may puncture through the layers 704 and 706 to reach the layer 708.

In another embodiment, a microelectromechanical switch may include two moveable electrical contacts separated by a gap, for example. The contacts may be formed of a metal. When a predetermined electrical energy is applied across the contacts, the contacts are moved through the gap towards each other to make electrical contact. This provides an electrical path between the contacts. Other mechanical switches according to further embodiments may include a metal rod that is actuated by wellbore pressure to puncture through the two conductors and an insulator layer. A memory alloy metal could also be used which would move and punch through the two conductors under the application of heat generated by an electrical current.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A perforating gun for use in a wellbore, comprising:

a plurality of shaped charges;

a plurality of initiator components including bridge-type initiators coupled to corresponding shaped charges; and an electrical cable coupled to the plurality of initiator components, each initiator component including an energy source adapted to be energized by a voltage on the electrical cable, the energy source providing energy for activating the bridge-type initiator.

2. The perforating gun of claim 1, wherein each energy source includes a capacitor.

3. The perforating gun of claim 1, wherein the bridge-type initiator includes an exploding foil initiator.

4. The perforating gun of claim 1, wherein the bridge-type initiator includes an exploding bridgewire initiator.

5. The perforating gun of claim 1, wherein each energy source includes a capacitor, and wherein each initiator component includes a switch coupling the capacitor to the bridge-type initiator.

6. The perforating gun of claim 5, wherein the switch and bridge-type initiator are formed on a common support structure.

7. The perforating gun of claim 5, wherein the switch includes an assembly of a first conductor layer, an intermediate insulator layer, and a second conductor layer.

8. The perforating gun of claim 7, wherein the switch includes a plasma switch.

9. The perforating gun of claim 8, wherein the switch further includes a diode electrically coupled to the first conductor layer, and wherein the second conductor layer is electrically coupled to the bridge-type initiator.

10. The perforating gun of claim 1, wherein the bridge-type initiator includes a first insulator layer, an intermediate conductor layer, and a second insulator layer.

11. The perforating gun of claim 10, wherein the conductor layer includes a neck portion that is adapted to go through a phase change in response to an applied current to create a plasma that causes at least a portion of the first insulator layer to separate from the bridge-type initiator.

12. The perforating gun of claim 11, wherein each initiator component further includes a barrel and an explosive, and wherein the separated portion flies through the barrel to impact the explosive to detonate a corresponding shaped charge.

13. A method of activating a tool having a plurality of explosive devices, comprising:

providing an initiator device having a bridge-type initiator proximal each explosive device;

providing an electrical cable to activate each initiator device;

supplying a first voltage to charge energy sources in corresponding initiator devices; and supplying an activating signal to couple each energy source to a corresponding bridge-type initiator to activate the bridge-type initiator to detonate an explosive device.

14. The method of claim 13, wherein supplying the first voltage includes supplying a voltage to charge a capacitor in each energy source.

15. The method of claim 13, further comprising activating the initiator device substantially simultaneously.

16. An apparatus for activating an explosive device in a downhole tool, comprising:

a capacitor discharge unit having a bridge-type initiator, a capacitor, and a switch coupling the capacitor and the bridge-type initiator, the capacitor providing the energy source for the bridge-type initiator, the capacitor discharge unit further including a support structure on which at least the bridge-type initiator and switch are mounted.

17. The apparatus of claim 16, further comprising one or more additional capacitor discharge units coupled to corresponding one or more explosive devices.

18. The apparatus of claim 16, further comprising an electrical cable coupled to the capacitor discharge units, the electrical cable adapted to receive a voltage to charge the capacitor in each capacitor discharge unit.

19. The apparatus of claim 16, wherein the bridge-type initiator includes an exploding foil initiator.

20. The apparatus of claim 16, wherein the bridge-type initiator includes an exploding bridgewire initiator.

21. A tool, comprising:

a plurality of explosive devices;

a plurality of initiator devices each including a bridge-type initiator adapted to detonate a corresponding explosive device, each initiator device including an energy source; and an electrical cable adapted to energize the energy source in each initiator device, each energy source providing activation power to a corresponding bridge-type initiator.

22. The tool of claim 21, wherein the initiator device includes a capacitor discharge unit.

23. The tool of claim 21, wherein the energy source includes a capacitor.

24. The tool of claim 21, further comprising a switch coupling the capacitor and the bridge-type initiator.

25. The tool of claim 24, wherein each initiator device further includes a support structure on which the switch and bridge-type initiator are mounted.

26. The tool of claim 24, wherein the switch includes a plasma switch.

27. The tool of claim 24, wherein the switch includes an over-voltage switch.

28. The tool of claim 24, wherein the switch includes a mechanical switch.

29. The tool of claim 24, wherein the switch includes a microelectromechanical switch.

30. A method of detonating one or more explosive devices in a wellbore, comprising:

providing a plurality of bridge-type initiators for initiating the explosive devices;

coupling a plurality of energy sources to corresponding explosive devices; and supplying an activating signal on an electrical cable to couple the energy sources to the bridge-type initiators to activate the bridge-type initiators.

31. An apparatus for activating explosive devices, comprising:

a distributed energy system including a plurality of energy sources and corresponding bridge-type initiators positioned proximal the explosive devices and an electrical cable coupled to energize the energy sources and to activate the bridge-type initiators with energy from the energy sources.

32. The perforating gun of claim 1, wherein each energy source is positioned proximal the corresponding shaped charge.

33. The perforating gun of claim 1, wherein each energy source is a local energy source for the corresponding initiator component.

34. The perforating gun of claim 1, wherein each energy source is adapted to be activated by the voltage on the electrical cable to provide the energy for activating the corresponding bridge-type initiator.

* * * * *

UNITED STATES PATENT AND TRADEMARK OFFICE

CERTIFICATE OF CORRECTION

PATENT NO. : 6,386,108 B1 
DATED : May 14, 2002
INVENTOR(S) : James Brooks and Nolan C. Lerche It is certified that error appears in the above-identified patent and that said Letters Patent is hereby corrected as shown below:

Title page,
Item [73], Assignee, add -- Schlumberger Technology Corporation, Sugar Land TX (US) --

Signed and Sealed this

Fourth Day of January, 2005

JON W. DUDAS
*Director of the United States Patent and Trademark Office*